US007458478B2

(12) United States Patent
Kamineni

(10) Patent No.: US 7,458,478 B2
(45) Date of Patent: Dec. 2, 2008

(54) HOT-FILLABLE CONTAINER WITH CONVEX SIDEWALL AREAS THAT DEFORM UNDER VACUUM CONDITIONS

(75) Inventor: Satya Kamineni, Lockport, IL (US)

(73) Assignee: Constar International Inc., Philadelphia, PA (US)

( * ) Notice: Subject to any disclaimer, the term of this patent is extended or adjusted under 35 U.S.C. 154(b) by 0 days.

(21) Appl. No.: 11/623,802

(22) Filed: Jan. 17, 2007

(65) Prior Publication Data

US 2008/0169266 A1 Jul. 17, 2008

(51) Int. Cl.
*B65D 1/02* (2006.01)

(52) U.S. Cl. ..... 215/381; 215/379; 220/669; 220/675

(58) Field of Classification Search ..... 215/379, 215/381, 384, 382, 383, 900; 220/609, 675, 220/666, 669, 771
See application file for complete search history.

(56) References Cited

U.S. PATENT DOCUMENTS

| | | | | |
|---|---|---|---|---|
| 4,381,061 | A | 4/1983 | Cerny et al. | |
| 4,946,053 | A * | 8/1990 | Conrad | 215/381 |
| 5,141,121 | A * | 8/1992 | Brown et al. | 215/381 |
| 5,238,129 | A | 8/1993 | Ota | |
| 5,303,834 | A | 4/1994 | Krishnakumar et al. | |
| 5,337,909 | A | 8/1994 | Vailliencourt | |
| 5,392,937 | A | 2/1995 | Prevot et al. | |
| 5,704,503 | A | 1/1998 | Krishnakumar et al. | |
| 6,375,025 | B1 | 4/2002 | Mooney | |
| 6,467,639 | B2 | 10/2002 | Mooney | |
| 6,497,333 | B1 | 12/2002 | Ellis et al. | |
| 6,502,369 | B1 | 1/2003 | Andison et al. | |
| 6,637,613 | B2 * | 10/2003 | Shimada et al. | 215/382 |
| 6,837,390 | B2 * | 1/2005 | Lane et al. | 215/381 |
| 7,296,702 | B2 * | 11/2007 | Tanaka et al. | 215/383 |
| 2005/0067369 | A1 * | 3/2005 | Trude | 215/381 |
| 2005/0121408 | A1 * | 6/2005 | Deemer et al. | 215/381 |
| 2005/0121409 | A1 * | 6/2005 | Penny et al. | 215/384 |

FOREIGN PATENT DOCUMENTS

WO WO 2006/039523 A1 * 4/2006

* cited by examiner

*Primary Examiner*—Sue A Weaver
(74) *Attorney, Agent, or Firm*—Wilmer Cutler Pickering Hale & Dorr LLP

(57) ABSTRACT

A hot fillable container includes a bottom and a sidewall connected with the bottom so as to define an internal space. The sidewall is further shaped so as to define in transverse cross-section a first convex sidewall label area having a first convexly curved outer surface having a first curvature and a second convex sidewall area having a second convexly curved outer surface having a second curvature. The label area is of the type that has no horizontal reinforcing ribs. The sidewall is constructed and arranged so that deformation of the sidewall in response to a partial vacuum condition within the internal space after a hot fill process will result in a decrease of the first curvature and an increase of the second curvature. This deformation is effected without any denting of the sidewall.

28 Claims, 4 Drawing Sheets

HOT-FILLABLE CONTAINER WITH CONVEX SIDEWALL AREAS THAT DEFORM UNDER VACUUM CONDITIONS

BACKGROUND OF THE INVENTION

1. Field of the Invention

This application relates to blow-molded containers, and more particularly to hot-fillable containers that are constructed to flexibly accommodate volumetric contraction that will occur in response to cooling of product within the container.

2. Description of the Related Technology

Perishable food and beverage products such as fruit juices are typically filled at elevated temperatures, such as 180 to 190 degrees Fahrenheit, under variable pressure conditions into specially designed plastic containers in what is conventionally referred to as the hot-fill process. Container designs that are intended for use with this process are referred to as hot fill type containers. After filling, the containers are sealed, preventing mass transfer into and out of the container. As the product within the containers cools, the volume that is occupied by the product decreases, thereby inducing a partial vacuum within the container that exerts an inward force upon the sidewall of the container. The design of hot fill type containers is heavily influenced by the necessity of managing this shrinkage during cooling. In the past, the shrinkage has most commonly been accommodated by molding one or more concave vacuum panel areas into the sidewall of the container that are designed to deflect inwardly as the product cools. By substantially limiting the deformation to the vacuum panel areas, unwanted distortion of other portions of the container is prevented. Such vacuum panel areas may serve the dual purpose helping consumers gain a better grip on the container during use after the container has been filled and distributed to the consumer.

While container designs relying upon vacuum panels have been effective in many ways, certain limitations and disadvantages are associated with their use, including limitations as to the possible variations in the exterior styling of the container, the need to provide enough plastic material to form the vacuum panels with the requisite thickness, and incompatibility with certain types of package labeling processes. For example, certain types of adhesive labels, especially clear labels, have a tendency to crimp in unsightly fashion due to flexure of the container during use with conventional hot fill container designs. Accordingly, a number of manufacturers find the presence of ribs and vacuum panels undesirable in their containers.

A need exists for an improved hot fillable container design without vacuum panels or ribs that obviates the various limitations and disadvantages of conventional hot fill container designs, such as the problem of label crimping.

SUMMARY OF THE INVENTION

It is accordingly an object of the invention to provide an improved hot fillable container design without vacuum panels or ribs that obviates the various limitations and disadvantages of conventional hot fill container designs, such as the problem of label crimping.

In order to achieve the above and other objects of the invention, a hot fillable container according to one aspect of the invention includes a bottom and a sidewall connected with the bottom so as to define an internal space. The sidewall is further shaped so as to define in transverse cross-section a first convex sidewall label area having a first convexly curved outer surface having a first curvature and a second convex sidewall area having a second convexly curved outer surface having a second curvature. The label area is of the type that has no horizontal reinforcing ribs. The sidewall is constructed and arranged so that deformation of the sidewall in response to a partial vacuum condition within the internal space after a hot fill process will result in a decrease of the first curvature and an increase of the second curvature. This deformation is effected without any denting of the sidewall.

A hot fillable container according to a second aspect of the invention includes a bottom; and a sidewall connected with the bottom so as to define an internal space, the sidewall being shaped so as to define in transverse cross-section: a first convex sidewall label area having a first convexly curved outer surface having a first radius, the label area having no reinforcing ribs, and a second convex sidewall area having a second convexly curved outer surface having a second radius, and wherein an axis along which the second radius is located intersects an axis along which the first radius is located at an angle which is preferably within a range of about 90 degrees to about 145 degrees; and a third convex sidewall area, the third convex sidewall area being constructed and arranged to substantially maintain its shape in response to a partial vacuum condition within said internal space.

According to a third aspect of the invention, a hot fillable container includes a bottom and a sidewall connected with said bottom so as to define an internal space, the sidewall being shaped so as to define in transverse cross-section: a first convex sidewall label area having a first convexly curved outer surface having a first radius R1, the label area having no reinforcing ribs, and a second convex sidewall area having a second convexly curved outer surface having a second radius R2 that increases in response to a partial vacuum condition within the internal space; and a third convex sidewall area having a third convexly curved outer surface having a third radius R3, and wherein a ratio $R_3/R_1$ is within a range of between about 0.5 to about 1.8

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
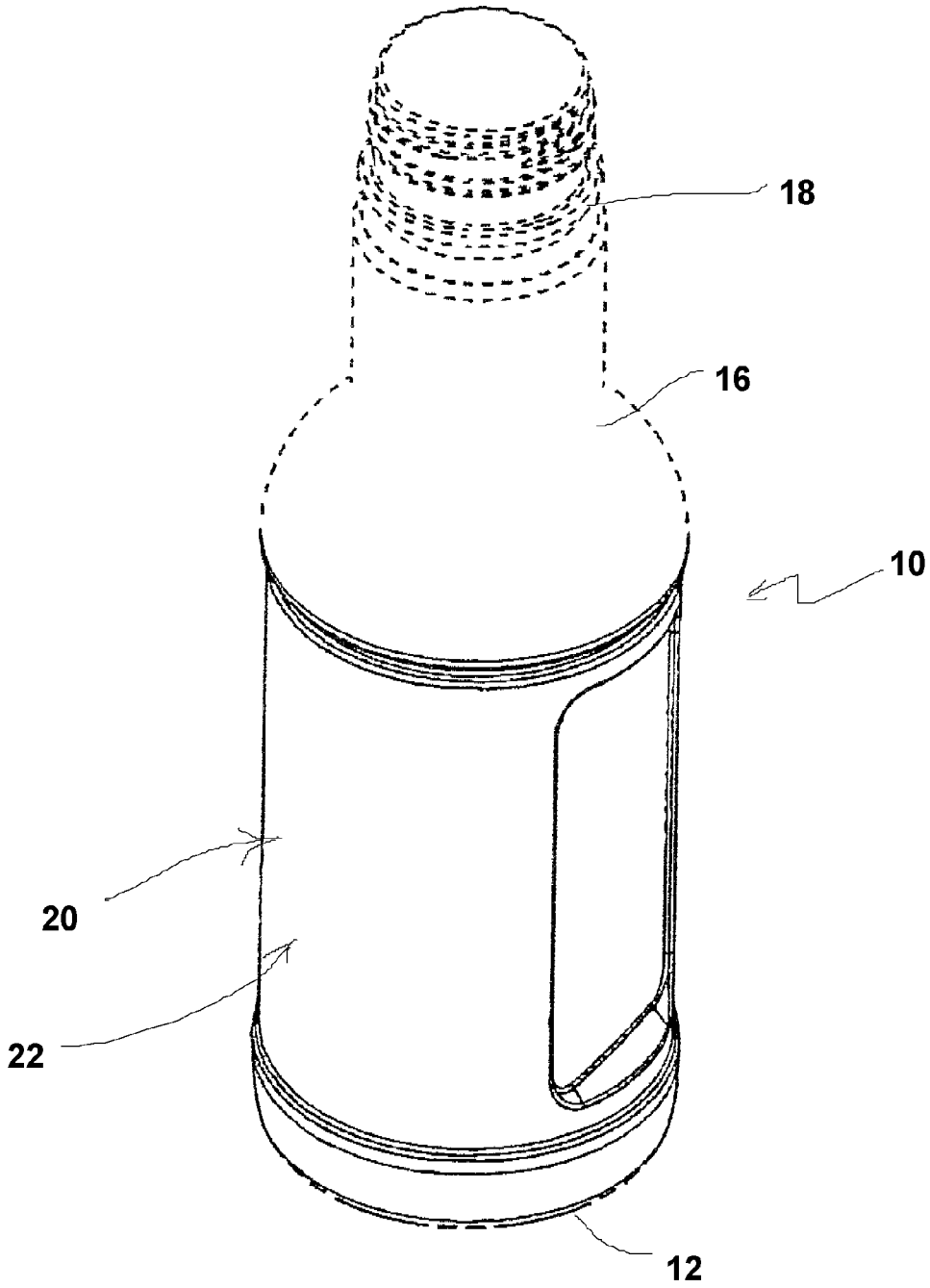
FIG. 1 is a perspective view of an improved hot fill container that is constructed according to a preferred embodiment of the invention.
Figure 2:
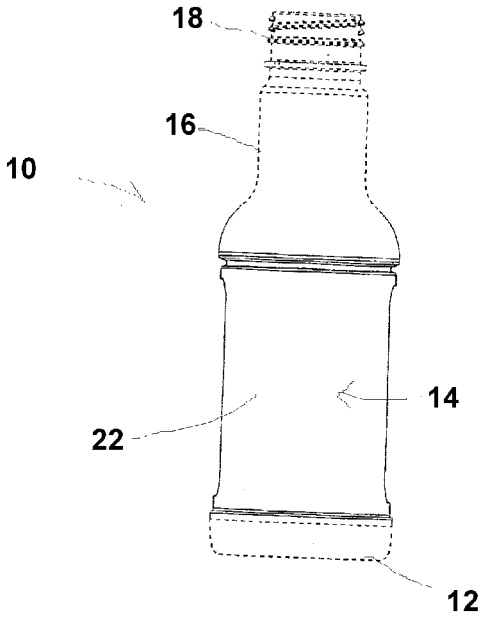
FIG. 2 is a front elevational view of the container that is depicted in FIG. 1.
Figure 3:
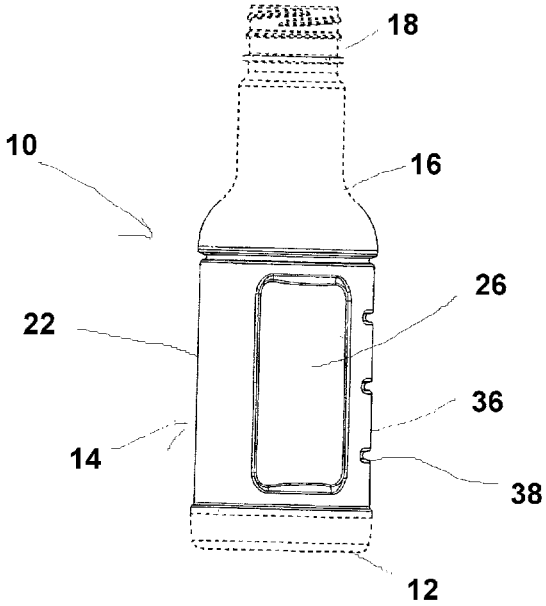
FIG. 3 is a side elevational view of the container that is shown in FIGS. 1 and 2.

Referring now to the drawings, wherein like reference numerals designate corresponding structure throughout the views, and referring in particular to FIG. 1, a hot fillable container 10 according to a preferred embodiment of the invention includes a bottom 12, a main body portion 14 and a neck portion 16 that terminates in a threaded finish portion 18.

Main body portion 14 includes a sidewall 20 that is connected with the bottom 12 and the neck portion 16 and that together with the bottom 12 and the neck portion 16 defines an internal space within the container 10. Sidewall 20 is constructed so that the label area has no vacuum panels and no reinforcing ribs such as horizontal reinforcing ribs that are commonly used to increase the hoop strength of such containers. Sidewall 20 has a thickness that is preferably although not necessarily uniform throughout the entire main body portion 14.

Figure 4:
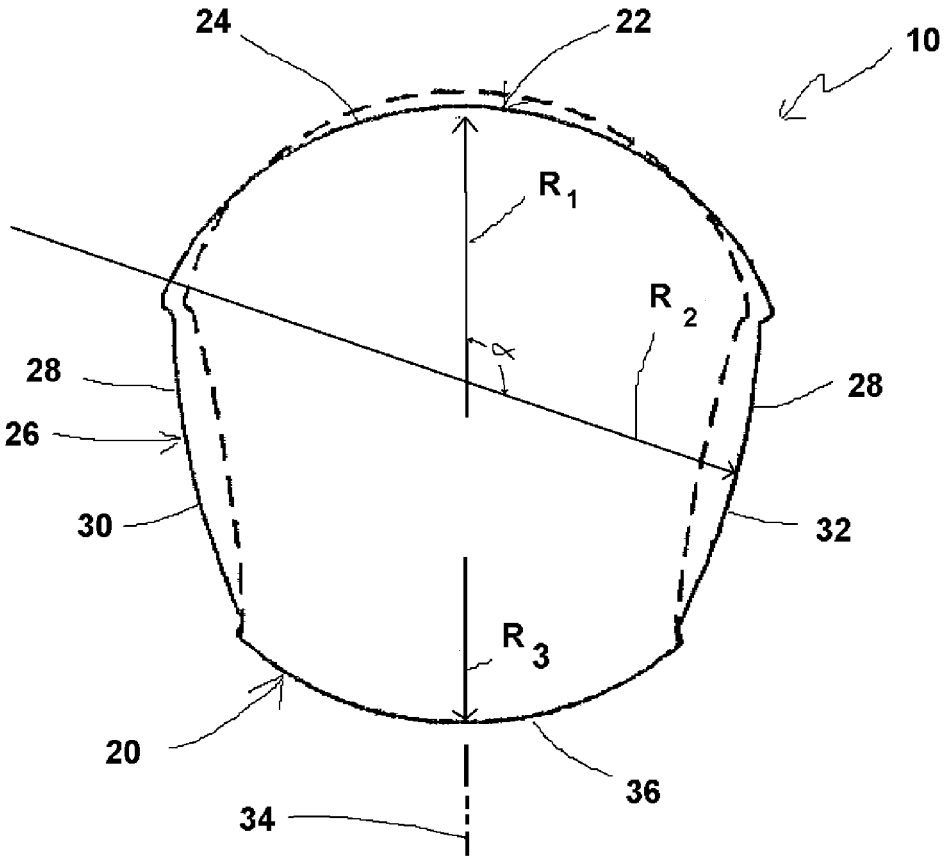
FIG. 4 is a transverse cross-sectional view taken through a body of the container that is depicted in FIGS. 1-3.

As is best shown in FIG. 4, sidewall 20 is shaped so as to define in transverse cross-section a first convex side wall label area 22 having a first convexly curved outer surface 24 that has a first curvature. The first convex side wall area 22 preferably occupies at least 15% of the total circumference of the sidewall 20 as viewed in FIG. 4. More preferably, convex side wall area 22 occupies at least 20% and even more preferably at least 25% of the total circumference of the sidewall 20.

The first convex side wall area 22 is preferably shaped as a portion of a cylinder, meaning that it has a substantially constant radius $R_1$ when viewed in transverse cross-section as is shown in FIG. 4. The sidewall 20 is preferably constructed and arranged so that deformation of the sidewall 20 in response to a partial vacuum condition within the internal space of the magnitude that would occur at the completion of a hot-fill process will not cause any dents in the sidewall 20 and will result in a decrease of the first curvature and the radius of curvature $R_1$ of the first convex sidewall area 22. In FIG. 4, the shape of the sidewall 20 as molded is shown in solid lines, while the shape of the sidewall 20 in response to a partial vacuum condition within the internal space of the magnitude that would occur at the completion of the hot-fill process is shown in broken lines.

Referring again to FIG. 4, the sidewall 20 further includes a second convex side wall area 26 having a second convexly curved outer surface 28 that has a second curvature. As molded, the second convex side wall area 26 is substantially in the shape of a portion of a cylinder when viewed in transverse cross-section as is shown in FIG. 4.

Sidewall 20 is preferably constructed and arranged so that a radius of curvature $R_2$ Of the second curvature will increase in response to a partial vacuum condition within the internal space of the magnitude that would occur at the completion of the hot-fill process. Preferably, the shape change occurs to an extent that the convexity of the second convexly curved outer surface 28 inverts into a concave shape, as is shown diagrammatically in FIG. 4. The second convex side wall area 26 in the preferred embodiment includes a first portion 30 and a second portion 32, which preferably are located on opposite sides of the first sidewall area 22 and share a common axis of symmetry. This axis of symmetry 34 preferably bisects the first convex side wall area 22, as is shown in FIG. 4.

Radius $R_2$ is preferably larger in magnitude than radius $R_1$ both as molded and in response to hot-fill induced underpressure within the container, although the vector direction of the radius $R_2$ will transition from a positive to a negative value as measured along an axis parallel to the radius $R_2$ when the second convexly curved outer surface 28 inverts into a concave shape. Specifically, a ratio $R_1/R_2$ will preferably remain within a range of about 0.7 to about −0.7 both as molded and during and after the hot fill process. More preferably the ratio $R_1/R_2$ will preferably remain within a range of about 0.5 to about −0.5 both as molded and during and after the hot fill process.

The axis along with radius $R_2$ is located intersects the axis along which radius $R_1$ is located at an angle $\alpha$, which is preferably within a range of about 90 degrees to about 145 degrees and is more preferably within a range of about 90 degrees to about 130 degrees.

Sidewall 20 further in the preferred embodiment includes a third convex sidewall area 36 that is constructed and arranged to substantially maintain its original as molded shape in response to a partial vacuum condition within the internal space of the magnitude that would occur at the conclusion of the hot fill process after cooling. The third convex side wall area 36 is preferably substantially in the shape of a portion of a cylinder and is constructed and arranged to have a radius of curvature $R_3$ when viewed in transverse cross-section as is shown in FIG. 4.

A ratio $R_3/R_1$ as molded and during and after the hot-fill process is preferably within a range of between about 0.5 to about 1.8 and is more preferably within a range of about 0.8 to about 1.3. Preferably, however, $R_1$ and $R_3$ are substantially the same as molded. The third convex side wall area 36 is preferably symmetrically opposed to the first convex side wall area 22 and is preferably bisected by the axis of symmetry 34. Reinforcing ribs 38 are preferably provided in third area 36 to ensure that the shape of the third area does not substantially change in response to a partial vacuum condition within the internal space of the magnitude that would occur at the conclusion of the hot fill process after cooling. The first and second portions 30, 32 of the second sidewall area 26 respectively separate the first convex sidewall area 22 from the third convex sidewall area 36.

In use, a first front label is preferably applied to first convex sidewall area 22 and a second rear label is adhesively applied to the third convex side wall area 36.

Alternatively, the third convex side wall area 36 could be constructed without reinforcing ribs so as to permit flexure during the hot fill process. In this embodiment, the shape of the third convex side wall area 36 would change and radius R3 would decrease in response to hot-fill induced underpressure within the container 10.

Figure 5:
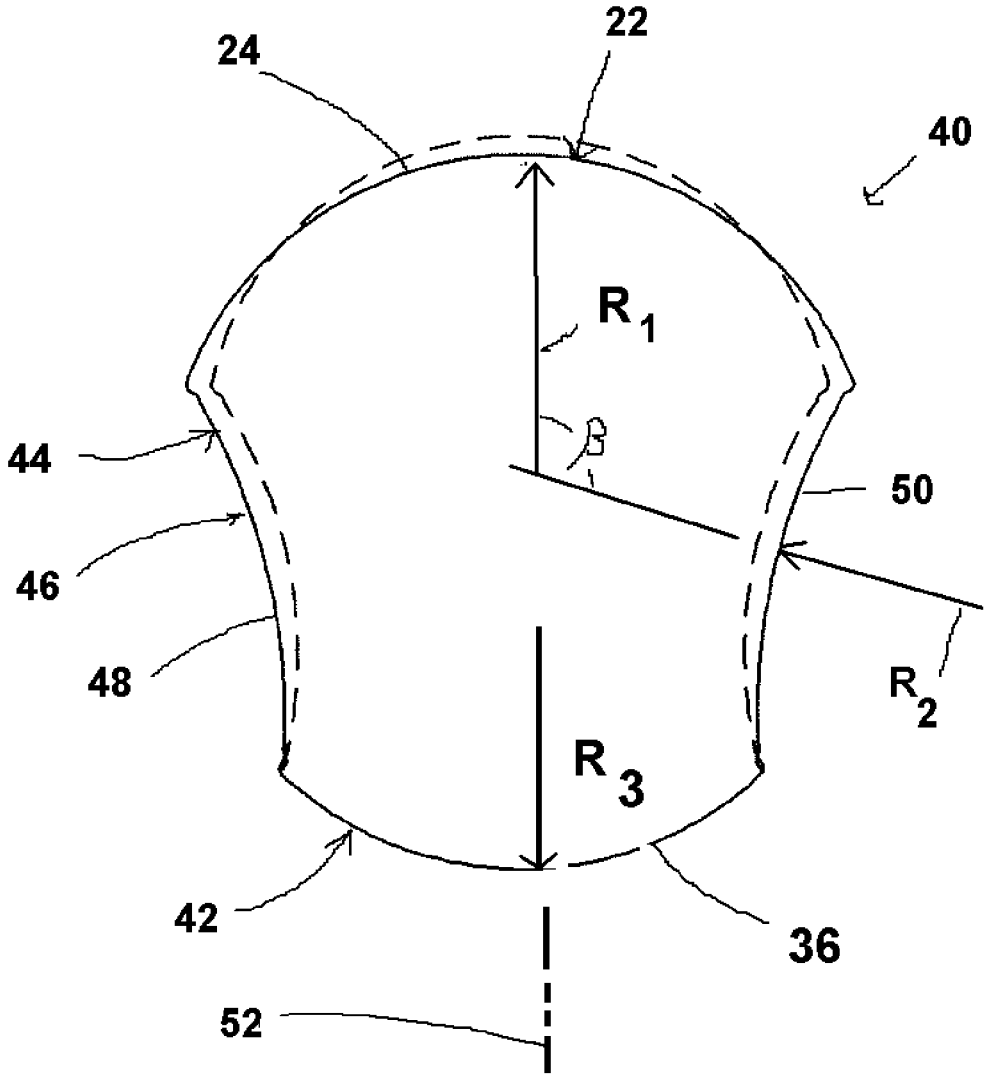
FIG. 5 is a transverse cross-sectional view taken through a body of the container that is constructed according to an alternative embodiment of the invention.

As is best shown in FIG. 5, a container 40 that is constructed according to an alternative embodiment of the invention includes a sidewall 42 that is shaped so as to define in transverse cross-section a first convex side wall label area 22 having a first convexly curved outer surface 24 that has a first curvature. The first convex side wall area 22 preferably occupies at least 15% of the total circumference of the sidewall 42 as viewed in FIG. 5. More preferably, first convex side wall area 22 occupies at least 20% and even more preferably at least 25% of the total circumference of the sidewall 42.

The first convex side wall area 22 is preferably shaped as a portion of a cylinder, meaning that it has a substantially constant radius $R_1$ when viewed in transverse cross-section as is shown in FIG. 5. As in the previously described embodiment, the sidewall 42 is preferably constructed and arranged so that deformation of the sidewall 42 in response to a partial vacuum condition within the internal space of the magnitude that would occur at the completion of a hot-fill process will not cause any dents in the sidewall 42 and will result in a decrease of the first curvature and the radius of curvature $R_1$ of the first convex sidewall area 22. In FIG. 5, the shape of the sidewall 42 as molded is shown in solid lines, while the shape of the sidewall 42 in response to a partial vacuum condition within the internal space of the magnitude that would occur at the completion of the hot-fill process is shown in broken lines.

Referring again to FIG. 5, the sidewall 42 further includes a second, concave side wall area 44 having a second, concavely curved outer surface 46 that has a second curvature. As molded, the second concave side wall area 44 is substantially in the shape of a portion of a cylinder when viewed in transverse cross-section as is shown in FIG. 5.

Sidewall 42 is preferably constructed and arranged so that a radius of curvature $R_2$ Of the second curvature will increase in response to a partial vacuum condition within the internal space of the magnitude that would occur at the completion of the hot-fill process. The second concave side wall area 44 in the preferred embodiment includes a first portion 48 and a second portion 50, which preferably are located on opposite sides of the first sidewall area 22 and share a common axis of symmetry. This axis of symmetry 52 preferably bisects the first convex side wall area 22, as is shown in FIG. 4.

Radius $R_2$ is preferably larger in magnitude than radius $R_1$ both as molded and in response to hot-fill induced underpressure within the container. Specifically, a ratio $R_1/R_2$ will preferably remain within a range of about 0.7 to about −0.7 both as molded and during and after the hot fill process. More preferably the ratio $R_1/R_2$ will preferably remain within a range of about 0.5 to about −0.5 both as molded and during and after the hot fill process.

The axis along with radius $R_2$ is located intersects the axis along which radius $R_1$ is located at an angle $\beta$, which is preferably within a range of about 90 degrees to about 145 degrees and is more preferably within a range of about 90 degrees to about 130 degrees.

Sidewall 42 further in this alternative embodiment includes a third convex sidewall area 36 that is constructed and arranged to substantially maintain its original as molded shape in response to a partial vacuum condition within the internal space of the magnitude that would occur at the conclusion of the hot fill process after cooling. The third convex side wall area 36 is preferably substantially in the shape of a portion of a cylinder and is constructed and arranged to have a radius of curvature $R_3$ when viewed in transverse cross-section as is shown in FIG. 5.

A ratio $R_3/R_1$ as molded and during and after the hot-fill process is preferably within a range of between about 0.5 to about 1.8 and is more preferably within a range of about 0.8 to about 1.3. Preferably, however, $R_1$ and $R_3$ are substantially the same as molded. The third convex side wall area 36 is preferably symmetrically opposed to the first convex side wall area 22 and is preferably bisected by the axis of symmetry 52. Reinforcing ribs 38 are preferably provided in third area 36 to ensure that the shape of the third area does not substantially change in response to a partial vacuum condition within the internal space of the magnitude that would occur at the conclusion of the hot fill process after cooling. The first and second portions 48, 50 of the second sidewall area 44 respectively separate the first convex sidewall area 22 from the third convex sidewall area 36.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot fillable container, comprising:

a bottom; and a sidewall connected with said bottom so as to define an internal space, said sidewall being shaped so as to define in transverse cross-section:

a first convex sidewall label area having a first convexly curved outer surface having a first curvature, a second convex sidewall area having a second convexly curved outer surface having a second curvature, wherein said sidewall is constructed and arranged so that deformation of said sidewall in response to a partial vacuum condition within said internal space after a hot fill process will result in a decrease of said first curvature and an increase of said second curvature, said deformation being effected without any denting of said sidewall, and a third convex side wall area, said third convex sidewall area being constructed and arranged to substantially maintain its shape in response to a partial vacuum condition within said internal space, wherein said third convex side wall area is symmetrically opposed to said first convex side wall area.

2. A hot fillable container according to claim 1, wherein said label area has no vacuum panels defined therein.

3. A hot fillable container according to claim 1, wherein said second convex side wall portion includes a first portion and a second portion that is separated from said first portion.

4. A hot fillable container according to claim 3, wherein said first portion and said second portion share a common axis of symmetry.

5. A hot fillable container according to claim 4, wherein said common axis of symmetry bisects said first convex sidewall area.

6. A hot fillable container according to claim 1, wherein said second convex sidewall area assumes a concave shape in response to a partial vacuum condition within said internal space after a hot fill process.

7. A hot fillable container according to claim 1, wherein said first convex sidewall area comprises at least 15% of a total circumference of said sidewall when viewed in transverse cross-section.

8. A hot fillable container according to claim 7, wherein said first convex side wall area comprises at least 20% of the total circumference of said sidewall when viewed in transverse cross-section.

9. A hot fillable container according to claim 8, wherein said first convex sidewall area comprises at least 25% of the total circumference of said sidewall when viewed in transverse cross-section.

10. A hot fillable container according to claim 1, wherein said first curvature is substantially in the shape of a portion of a cylinder having a first radius of curvature, said first radius of curvature decreasing in response to a partial vacuum condition within said internal space.

11. A hot fillable container according to claim 1, wherein said second curvature is substantially in the shape of a portion of a cylinder when said container is molded, said second curvature having a second radius of curvature that increases in response to a partial vacuum condition within said internal space.

12. A hot fillable container according to claim 11, wherein said second radius of curvature inverts in response to a partial vacuum condition within said internal space, whereby said second curvature becomes a concave curvature.

13. A hot fillable container according to claim 1, wherein said second convex side wall area comprises a first portion and a second portion, said first and second portions respectively separating said first convex side wall area from said third convex side wall area.

14. A hot fillable container according to claim 1, wherein a ratio of said first curvature to said second curvature is within a range of about 0.7 to about −0.7.

15. A hot fillable container according to claim 14, wherein a ratio of said first curvature to said second curvature is within a range of about 0.5 to about −0.5.

16. A hot fillable container, comprising:

a bottom; and a sidewall connected with said bottom so as to define an internal space, said sidewall being shaped so as to define in transverse cross-section:

a first convex sidewall label area having a first convexly curved outer surface having a first radius, and a second convex sidewall area having a second convexly curved outer surface having a second radius, and wherein an axis along which said second radius is located intersects an axis along which said first radius at an angle which is preferably within a range of about 90 degrees to about 145 degrees; and a third convex sidewall area, said third convex sidewall area being constructed and arranged to substantially maintain its shape in response to a partial vacuum condition within said internal space, wherein said third convex side wall area is symmetrically opposed to said first convex side wall area.

17. A hot fillable container according to claim 16, wherein said angle is within a range of about 90 degrees to about 130 degrees.

18. A hot fillable container according to claim 16, wherein said second convex side wall area comprises a first portion and a second portion, said first and second portions respectively separating said first convex side wall area from said third convex side wall area.

19. A hot fillable container according to claim 16, wherein a ratio of said first radius to said second radius is within a range of about 0.7 to about −0.7.

20. A hot fillable container according to claim 19, wherein a ratio of said first radius to said second radius is within a range of about 0.5 to about −0.5.

21. A hot fillable container, comprising:

a bottom; and a sidewall connected with said bottom so as to define an internal space, said sidewall being shaped so as to define in transverse cross-section:

a first convex sidewall label area having a first convexly curved outer surface having a first Radius, and a second convex sidewall area having a second convexly curved outer surface having a second radius, and wherein an axis along which said second radius is located intersects an axis along which said first radius at an angle which is preferably within a range of about 90 degrees to about 145 degrees; and a third convex sidewall area, said third convex sidewall area being constructed and arranged to substantially maintain its shape in response to a partial vacuum condition within said internal space, wherein said third convex sidewall area has a third radius, and wherein a ratio of said third radius to said first radius is within a range of about between about 0.5 to about 1.8.

22. A hot fillable container according to claim 21, wherein a ratio of said third radius to said first radius is within a range of about 0.8 to about 1.3.

23. A hot fillable container, comprising:

a bottom; and a sidewall connected with said bottom so as to define an internal space, said sidewall being shaped so as to define in transverse cross-section:

a first convex sidewall label area having a first convexly curved outer surface having a first radius R1, and a second convex sidewall area having a second convexly curved outer surface having a second radius R2 that increases in response to a partial vacuum condition within said internal space; and a third convex sidewall area having a third convexly curved outer surface having a third radius R3, and wherein a ratio R3/R1 is within a range of between about 0.5 to about 1.8, wherein said third convex sidewall area is constructed and arranged to substantially maintain its shape in response to a partial vacuum condition within said internal space.

24. A hot fillable container according to claim 23, wherein said ratio R3/R1 is within a range of between about 0.8 to about 1.3.

25. A hot fillable container according to claim 23, wherein said third convex side wall area is symmetrically opposed to said first convex side wall area.

26. A hot fillable container according to claim 23, wherein said second convex side wall area comprises a first portion and a second portion, said first and second portions respectively separating said first convex side wall area from said third convex side wall area.

27. A hot fillable container according to claim 23, wherein a ratio of said first radius to said second radius is within a range of about 0.7 to about −0.7.

28. A hot fillable container according to claim 27, wherein a ratio of said first radius to said second radius is within a range of about 0.5 to about −0.5.

* * * * *